United States Patent [19]

Myren

[11] 4,028,174

[45] June 7, 1977

[54] APPARATUS FOR COLLECTING LIQUIDS THROWN FROM A MOVING MEMBER

[75] Inventor: Harry Ingemar Myren, Karlstad, Sweden

[73] Assignee: Aktiebolaget Karlstads Mekaniska Werkstad, Karlstad, Sweden

[22] Filed: May 14, 1976

[21] Appl. No.: 686,290

[30] Foreign Application Priority Data

Nov. 19, 1975 Sweden ..... 7512988

[52] U.S. Cl. ..... 162/264; 162/301; 162/352; 162/DIG. 7

[51] Int. Cl.[2] ..... D21F 1/66

[58] Field of Search ..... 162/264, 190, 301, 203, 162/352, DIG. 7; 210/247

[56] References Cited

UNITED STATES PATENTS

| | | | |
|---|---|---|---|
| 2,694,345 | 11/1954 | Hornbostel | 162/352 X |
| 3,056,719 | 10/1962 | Webster | 162/203 |
| 3,239,409 | 3/1966 | Knowles | 162/352 |
| 3,637,460 | 1/1972 | Newsom et al. | 162/352 |

*Primary Examiner*—S. Leon Bashore
*Assistant Examiner*—Richard V. Fisher
*Attorney, Agent, or Firm*—Brumbaugh, Graves, Donohue & Raymond

[57] ABSTRACT

A curved deflector for intercepting high velocity sprays of liquids thrown from a moving member has holes formed in the portion of the deflector remote from the member for permitting substantially all liquid collected by the deflector to pass through the holes and in so doing be substantially slowed in velocity, thereby substantially eliminating aeration from splashing and considerably reducing noise.

3 Claims, 3 Drawing Figures

APPARATUS FOR COLLECTING LIQUIDS THROWN FROM A MOVING MEMBER

BACKGROUND OF THE INVENTION

This invention relates to an improvement in curved deflectors used for intercepting and collecting as a layer on the deflector liquid thrown as a relatively high velocity spray from a moving member.

In the pulp and paper industry there are numerous instances in which liquids are thrown off at high velocity from a moving member. For example, in pulping operations, dewatering devices involving centrifugal separation techniques to dewater a pulp suspension require the collection of large amounts of liquids. Similar occurrences of high velocity liquid sprays thrown from moving members occur in paper and paper-board forming and pressing equipment. In the forming section the breast rolls and wire rolls in a Fourdrinier web former throw off large quantities of liquid at high velocity, and deflectors are often used to intercept and direct the liquid into a receptacle or receptacles. In the press section, liquid is thrown from suction rolls and grooved rolls and is collected by various means. Common to all of the foregoing examples of liquid collecting devices in the pulp and paper industries, as well as to similarequipment in other industries, is the desire to collect the liquid in a vessel with a minimum of aeration of the liquid and to keep the noise created by impingement of high velocity showers or sprays against the elements of the liquid collecting equipment as low as possible.

The problem of collecting large amounts of liquid moving at very high velocity in a spray is particularly acute in high speed web-forming machines of the type described and shown in Webster U.S. Pat. No. 3,056,719. In such webformingdevices, a fibrous web is formed in a curved forming space defined between a foraminous or porous belt held under tension toward a curved support, which can be a solid or perforated roll or a solid or perforated shoe. A ribbon-like jet of stock is introduced to the forming space and is then subjected to dewatering by a combination of unit pressure developed by virtue of the tensioning of the foraminous belt toward the curved support and centrifugal force generated in the stock as it moves through the curve. Throughout the forming zone, liquid is thrown out through the foraminous belt at a velocity substantially equal to the velocity of the moving foraminous belt. The Webster patent type formers are capable of being operated in speeds in excess of 5,000 feet per minute, and there are now many commercial installations throughout the world in which such speeds are common.

The collection devices for capturing the high velocity spray of liquid thrown off the foraminous belt in the Webster patent type formers comprise a large collector vessel that is, in some present commercial installations, equipped with one or more curved deflectors spaced along the extent of the curved forming zone. The inner ends of the deflectors are located close to the foraminous belt, and each deflector extends generally transversely across the entire width of the forming zone and presents a concave surface facing the high velocity liquid spray being thrown from the foraminous belt. The deflectors serve at least two purposes: first, they collect the spray and turn it into a layer or sheet on the concave face of the deflector and in the process deaerate the liquid; second, they change the direction of flow of the liquid and guide it toward the lower portion of the collector vessel, from which it is conducted away.

A problem with collection devices of the type described above is that a very high velocity jet of liquid is discharged from the end of the deflector either against a wall of the vessel or into an accumulation of liquid in the bottom of the vessel. One or more perforated plates or screens can be interposed between the bottom of the vessel and the trailing or downstream end of the deflector to break up and slow the jet, but there is inevitably some high velocity flow-through of the jet directly into the residual liquid in the bottom of the vessel. Moreover, the jet impinges at high velocity against the perforated plate or screen and becomes aerated and makes a lot of noise in so doing. Both with and without devices for breaking up the high velocity jet flowing off the end of the deflector, there is, therefore, inherently a great tendency toward aeration of the liquid, which creates problems when the liquid is recycled, and generation of undesirable levels of noise.

SUMMARY OF THE INVENTION

There is provided, in accordance with the invention, an improvement in the curved deflectors used in liquid collection devices of the type described above. The objectives sought and results achieved by the improvement are to minimize aeration of the liquid being collected and to reduce substantially the noise generated in the device. In accordance with the invention, a curved deflector is provided with a multiplicity of holes located along a band adjacent the edge of the deflector that extends lengthwise (in the cross machine direction) and is remote from the source of the liquid spray, i.e., a moving member from which liquid is thrown and remote from the zone of the deflector where liquid thrown from the deflector directly impinges. Substantially all liquid collected by the deflector passes through the holes rather than being discharged as a high velocity jet from the trailing end of the deflector. In the course of passing through the holes the velocity of the liquid is reduced to a small fraction of the velocity at which it flows along the deflector.

More particularly, the improvement, according to the invention, involves a deflector that extends generally transverse to the direction of the member from which liquid is being thrown. The deflector includes an inner edge located close to the member and an outer edge located remote from the member and has a curved transverse cross-section which is generally concave to the direction of movement of the member. A multiplicity of holes is formed in a portion of the deflector adjacent the outer edge for permitting substantially all liquid collected by the deflector to pass through the holes at a velocity substantially less than the velocity with which the liquid was thrown from the member.

The deflector intercepts and collects as a moving layer liquid thrown from the member and imposes on that liquid layer a centrifugal force as an inherent result of the curvature of the member. Considering a small quantity of liquid in the layer moving adjacent the surface of the deflector at a high velocity, at the point that the small quantity passes over the upstream edge of the hole, it ceases to be constrained by the centrifugal force imposed on it by the deflector to flow along in a curved path and will, therefore, move more or less straight and thus enter the hole. Consequently, that small quantity of liquid impinges against the downstream wall of the hole. The small quantity of liquid that confronts the wall of the hole will have no place to go but out through the hole on the convex side of the deflector, inasmuch as the part of the liquid layer that does not enter the hole closes the concave side of the hole.

The actual flow conditions that occur at a hole are extremely complex, and it would serve little purpose to present a detailed analysis here. It should be apparent, however, that each hole will, in effect, shear off a small quantity of liquid in the layer that is collected on the deflector and that that small quantity will be expelled from the back face of the deflector with a relatively small velocity. In equipment that has been constructed and tested in accordance with the present invention, the velocity with which liquid flows out through the holes is estimated to be about one-tenth of the velocity of the layer moving along the deflector surface.

For a better understanding of the invention, reference may be made to the following description of an exemplary embodiment, considered in conjunction with the figures of the accompanying drawings.

DESCRIPTION OF THE EMBODIMENT

Figure 1:
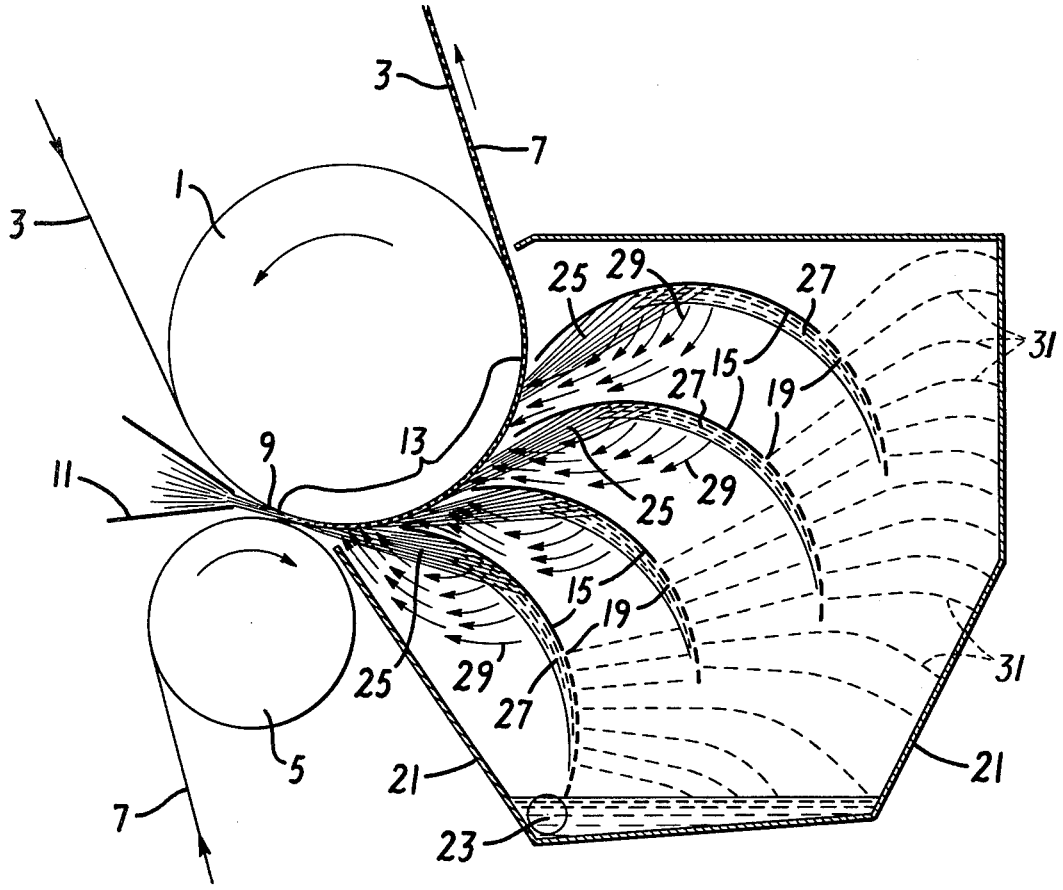
FIG. 1 is a schematic side view of a web-forming device equipped with a liquid collecting device embodying the invention.

In the exemplary embodiment illustrated in the drawings, the improvement, according to the present invention, is illustrated in conjunction with a Webster patent type web former used in the manufacture of paper. The web former comprises a rotatable forming roll 1, which may be impervious or pervious. An endless web 3, such as a metal or plastic paper-making wire or a felt is wrapped around part of the perimeter of the forming roll, and a foraminous endless belt, usually a paper-making wire 7, is led around a breast roll 5 and along a run over part of the perimeter of the forming roll 1 that is conjoint with run or wrap of the inner belt 3. A zone of convergence, the location of which is indicated generally by the reference number 9, is formed between the inner and outer belts 3 and 7. A ribbon-like jet of stock is propelled from the nozzle 11 of a headbox into the tapered inlet zone. A portion of the conjoint run of the inner and outer wires 3 and 7 around the forming roll 1, such portion being represented by the reference number 13 in FIG. 1, constitutes a forming zone where the stock is very rapidly dewatered and fixed into a fibrous web. At some point along the conjoint run dewatering essentially ceases, the location of such point being a variable that depends upon the construction and operating conditions of the equipment and the nature of the stock.

In the machines of the type illustrated schematically in FIG. 1, the surface velocity of the roll and the velocities of the belts 3 and 7 are often in excess of 5,000 feet per minute. As the stock is dewatered through the outer belt 7, the water is thrown out at a velocity substantially equal to the speed of the forming roll surface and the belts, the direction of throw of the water being substantially tangential throughout the length of the forming zone; in other words, at all points throughout the forming zone a tangential stream of water is thrown generally tangentially from the moving foraminous belt 7. The overall result is that a very high velocity spray of water exists throughout the extent of the forming zone.

FIG. 1 illustrates schematically a collector device for collecting the liquid thrown from the forming zone. The collector comprises a vessel 21 having an outlet 23 through which liquid collected in the bottom of the vessel is removed for return to the stock preparation part of the mill. Within the vessel 21 is a set of deflectors 15, each of which is a plate-like member that extends transversely across the width of the machine, has an upstream or inner edge located close to the forming zone 13 and is curved to present a concave face generally toward the direction of water spray being thrown from the forming zone. The deflectors are spaced from each other along the circumferential extent of the forming zone 13, and each is shaped and oriented such that its upstream or inner end portion is generally tangential to the forming zone, which respect to a point along the forming zone that is closely adjacent to the inner edge of the deflector. Accordingly, the angle of impingement of the myriad of small water jets against the deflectors is relatively small.

The drawing illustrates schematically the impingement of small water jets 25 thrown off the outer belt 7. Because of the curvature of the deflector, the jets of liquid are coalesced into a film 27 by the time they reach the centers of the deflectors. The centripetal forces imposed on the water by the curved deflectors minimizes entrainment of air in the water film or layer 27 collected on each deflector. The air released from the liquid, which is represented by the arrowed lines 29, is drawn back toward the forming zone by the suction caused by windage of the moving wire 7. The natural recirculation of air within the vessel 21 minimizes the need for air to enter the vessel 21 from outside and the tendency for a vacuum to be generated within the vessel 21.

As described up to this point, the apparatus shown in FIG. 1 is known. But for the invention, the liquid layers on the deflectors in the collecting device would flow off the trailing or outer ends of the deflectors, with only a modest reduction in velocity, as high velocity streams into the bottom of the vessel 21. Those streams would create a great deal of noise and generate considerable turbulence and splashing in the bottom of the vessel such that the liquid in the bottom of the vessel would be highly aerated.

Figure 3:
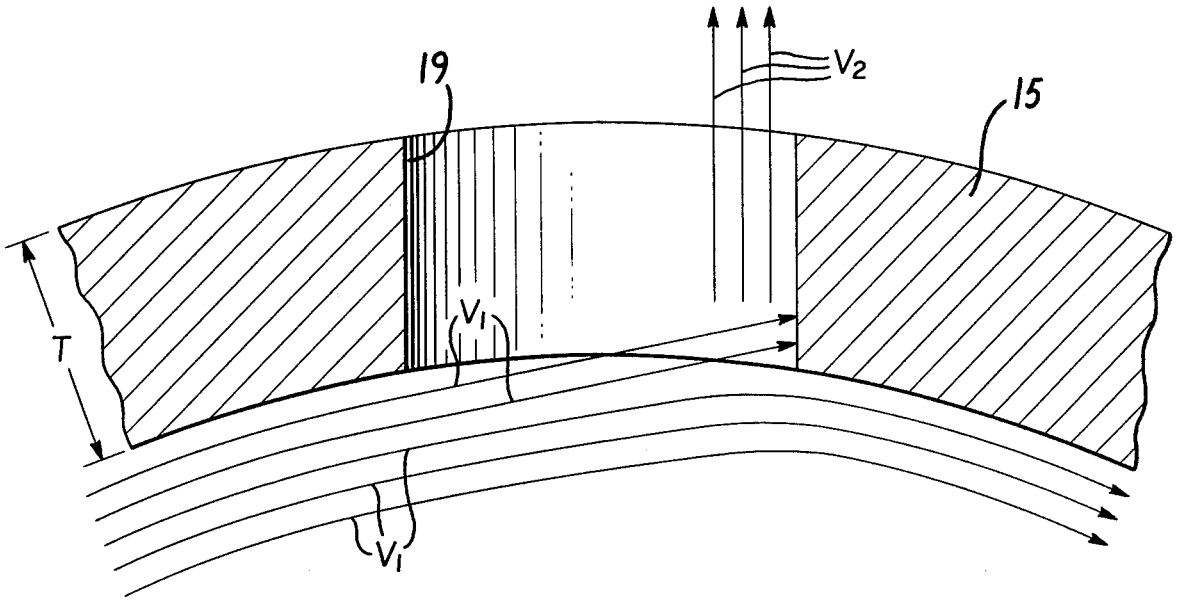
FIG. 3 is a fragmentary cross-sectional view depicting very generally the way in which an individual hole shears off a part of the liquid layer flowing along the deflector.

In accordance with the present invention, each of the deflectors 15 is provided in a band along the entire transverse dimension and along the downstream or outer portion with a multiplicity of small, closely spaced holes. The holes are, thus, located outside the zone of the deflector where the small jets 25 of water thrown from the wire 7 directly impinge. FIG. 3 of the drawing depicts very generally how the holes 19 work. In FIG. 3, the arrowed lines $V_1$, represent the layer or film 27 of water flowing at high velocity along the concave surface of the deflector 15. As long as the layer of water is constrained to move along the concave face of the deflector, it is subjected to a centripetal force, but when the layer encounters a hole, that centripetal force ceases, and a small quantity of water adjacent to the surface of the deflector 15 stops flowing along a curved path and instead flows straight, as indicated by the arrowed lines adjacent thesurface of the deflector 15 in FIG. 3. That small quantity of the liquid layer thus impinges on the downstream wall of the hole. The remainder of the liquid layer 27 blocks the hole on the concave side, so the liquid that enters the hole has nowhere to go but out through the hole. The nature of the flow conditions in the region of the hole are such that a small stream of water flows from the hole in a direction generally indicated by the arrows $V_2$ in FIG. 3 (also represented by the dashed lines 31 in FIG. 1). It has been estimated in tests of equipment embodying the invention that the velocity of the streams $V_2$ flowing from the holes is about 1/10th of the velocity $V_1$ of the layer of water along the deflector.

Figure 2:
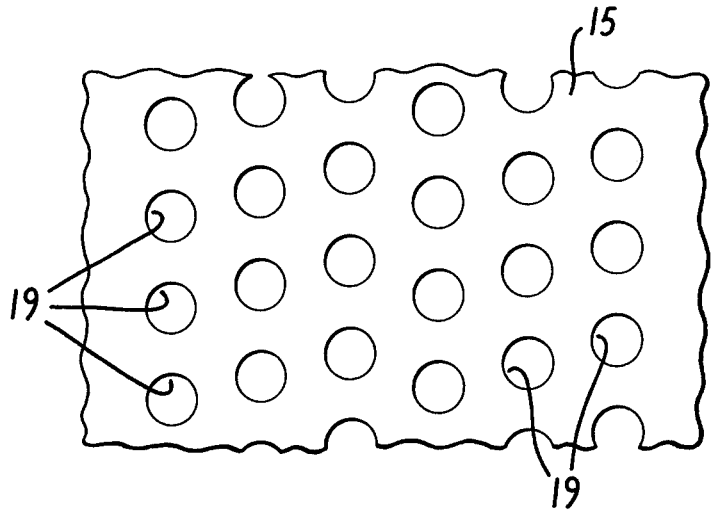
FIG. 2 is a fragmentary plan view of a representative pattern of holes in a deflector.

The sizes, number and location of the holes, though not critical, should fall within certain general guidelines. First of all, it is desirable for the holes to be small, though not so small as to present possible clogging or to produce a high hydraulic loss. In general, good results have been obtained with holes about ⅛ to ¼ inch in diameter. The holes can be circular, and that is preferable since they are easier to form, but the shape of the holes is not considered to be of importance. Inasmuch as the objective of the holes is to prevent the discharge of any jet or stream of water directly under high velocity against the wall of the vessel or the residual liquid in the bottom of the vessel, the total cross-sectional area of all holes, given the flow conditions that occur, should be sufficient to allow all of the liquid layer to flow out through the holes in small streams 31 (FIG. 1). The pattern of the holes should be such as to provide a substantially uniform outflow of liquid through the holes along the transverse lengths (transverse with respect to the paper machine) of the deflectors; thus the staggered relation illustrated in FIG. 2 is called for.

As mentioned above and shown in FIG. 1, the holes are located in the deflector in a zone that is remote from the zone where the jets 25 thrown from the wire directly impinge so that there is no opportunity for the jets 25 to flow at high velocity directly through the holes.

Finally, the thicknesses of the deflectors should be such that all liquid that shears off at a hole and flows out through the hole should impinge on the downstream wall of the hole. In practice, the structural requirements for the deflectors will normally dictate a thickness for the deflectors (the thickness being designated by the letter T in FIG. 3) that will be adequate. With holes approximately ¼ inch in diameter, a velocity of the liquid layer of about 5,000 feet per minute and with a curvature of the deflector in the region of the holes of about R=14 inches, a ⅛ inch thick deflector plate is adequate. It should be apparent that what is desired as far as plate thickness is concerned is to prevent any liquid from shearing off and passing through the hole without impinging on the downstream edge of the hole.

I claim:

1. In apparatus including a moving member from which liquid is thrown during movement thereof and at least one plate-like deflector positioned adjacent the member to intercept at least a portion of said liquid, the deflector extending generally transverse to the direction of movement of the member and having an inner edge located close to the member and an outer edge located remote from the member, and further having a curved transverse cross-section which is generally concave to the direction of movement of the liquid thrown from the member such that it intercepts and collects the liquid thereon as a moving layer, the improvement comprising means defining a multiplicity of holes located in a portion of the deflector adjacent to the outer edge and in a band along the length of the deflector remote from the member where substantially no liquid thrown from the member directly impinges for permitting substantially all liquid collected by the deflector to pass through said holes, a part of the liquid passing through and out of each hole as a stream moving at a velocity substantially less than the velocity with which the liquid was thrown from the member.

2. The improvement according to claim 1 wherein the holes are arranged in staggered relation such that they present to the liquid layer collected by the deflector a total area for flow of the liquid through the deflector that is substantially uniform along the transverse extent of the liquid layer.

3. The improvement according to claim 1 wherein the thickness of the deflector in the region where the holes are located is such that in relation to the curvature of the deflector in said region and the sizes and configurations of the holes a quantity of liquid passes through a hole by being freed from centripetal force as it moves over a hole and by impinging substantially entirely on a portion of the wall of the hole that faces the direction of flow of the liquid layer along the deflector.

* * * * *